US006168538B1

(12) United States Patent
Schy et al.

(10) Patent No.: US 6,168,538 B1
(45) Date of Patent: Jan. 2, 2001

(54) GOLF PRACTICE RANGE TEE DIVIDER

(75) Inventors: Mike Schy, Fresno; John Barss, Moss Landing, both of CA (US)

(73) Assignee: Fore Safety, Inc., Fresno, CA (US)

( * ) Notice: Under 35 U.S.C. 154(b), the term of this patent shall be extended for 0 days.

(21) Appl. No.: 09/239,885

(22) Filed: Jan. 29, 1999

(51) Int. Cl.[7] ..... A63B 69/36
(52) U.S. Cl. ..... 473/405; 473/168
(58) Field of Search ..... 473/150, 168–170, 473/197, 405

(56) References Cited

U.S. PATENT DOCUMENTS 5,269,527 * 12/1993 Noval ..... 473/197
5,482,269 1/1996 Scott et al. .
5,586,942 12/1996 Wittek, Sr. et al. .
5,603,669 2/1997 Scott et al. .

* cited by examiner

*Primary Examiner*—Mark S. Graham
(74) *Attorney, Agent, or Firm*—Brian J. Deagle

(57) ABSTRACT

The present invention provides an apparatus for separating golfers on a practice range. The present invention specifically provides an apparatus for improved safety from errant golf balls as well as "amenities," such as golf bag and drink storage, and which provides the practice range operator an additional advertising medium. The present invention provides an apparatus which is stable when struck by errant golf balls or during windy weather, however, the apparatus is constructed for quick and easy repositioning when reconfiguring the practice range tee area.

20 Claims, 5 Drawing Sheets

7
9B
8
9A 9
7
8
7
A

GOLF PRACTICE RANGE TEE DIVIDER

TECHNICAL FIELD OF THE INVENTION

The present invention provides an apparatus for separating golfers on a practice range. Specifically, the present invention provides an apparatus for improved safety from errant golf balls as well as "amenities."

BACKGROUND OF THE INVENTION

Golf is widely popular across the country and continues to increase in popularity through new entrants into the golfing community. Recent media events involving young golf professionals has increased the number of novice golfers who want to learn the game and become golfers, some of whom have never previously picked up a golf club. These novice golfers are joining experienced players at golf practice ranges around the country, and are increasing the pressure on practice range operators to provide safe comfortable practice spaces.

A golf range practice area comprises a large open rectangular or semi-circular like area with a hitting area for the golfers on one end thereof. The golfers then hit balls from the hitting area into the open area, i.e., practice hitting their golf shots. Golf practice facilities; usually supply golfers either a grass hitting area, or a synthetic hitting surface such as ASTROTURF. The synthetic hitting surfaces are usually provided in individual square-shaped mats with sides approximately four feet long. Some facilities alternate between the grass and synthetic mats as conditions dictate. It is important for the practice facility operator to ensure that each hitting area is spaced or separated to ensure that the practicing golfers will not be hit by swinging clubs or errant shots from other golfers.

The current art in golf tee separators include merely setting down markers in the grass hitting areas, usually in the form of a sphere approximately six inches in diameter, to outline a individual golfer's hitting area, or merely spacing the synthetic mats to provide space for golfers to swing a golf club without striking their golfing neighbor. None of these methods, however, provides the necessary degree of safety from errant golfing shots which may strike a neighboring golfer.

Other tee separators provide a physical barrier between practicing golfers, however these tee separators are made entirely of materials such as wood, plywood, hard plastic and steel, which will deflect golf balls, but not reduce golf ball velocity. The failure to reduce the velocity of an errant golf ball can result in the ricocheting ball striking a golfer, possibly causing injury. Therefore, there is a need in the field of tee separators to improve safety.

U.S. Pat. No. 5,603,669 and U.S. Pat. No. 5,586,942, describe tee separators that require spikes or fasteners to affix the tee divider to the ground or driving range pad. The spikes and fasteners assist in preventing the tee dividers, described therein, from tipping over in windy weather or when struck by an errant golf ball. These tee dividers, however, cannot be moved quickly or easily and provide little assistance to the golf practice range that rotates the teeing area from multiple grass sites and synthetic hitting areas.

In summary, existing golf practice tee separators fail to adequately protect the practicing golfer from errant shots and fail to give the practice range operator flexibility in configuring the tee areas. The golf practice facility industry needs a tee separator which will provided increased safety, while improving the comfort of the golfer and the revenue of the operator. The present invention provides a solution to that need.

SUMMARY OF THE INVENTION

The present invention provides a tee separator comprising:

(a) a substantially rigid frame having two ends, orientated substantially in a plane substantially perpendicular to a plane of golf teeing areas, and defining an interior open space where (i) the interior open space is surrounded by rigid frame members on at least three of four sides and (ii) the area of the interior open space defined by the rigid frame members is from about 7,400 $cm^2$ to about 30,000 $cm^2$;

(b) a barrier means composed of a thin and flexible sheet-like material that is substantially similar in size and shape to the interior open space, and where the sheet like material is fastened to the top frame member, and whereby the barrier means functions to absorb the force of moving objects that strike the barrier means and decrease the velocity of such moving objects; and (c) at least one footer means connected to the bottom frame member and orientated substantially parallel to the ground and which extends in both directions perpendicular from the plane of the interior open space, whereby the footer maintains orientation of the frame substantially perpendicular to the golf teeing area despite the forces of wind and being struck by moving objects.

A further embodiment of the present invention is where the interior open space is defined by (1) a top frame member having an overall length of about 120 cm to about 245 cm; (2) one or two side frame members substantially perpendicular to said golf teeing areas and having an overall height of about 60 cm to about 125 cm; and (3) a bottom frame member oriented substantially in parallel to the top frame member and having a length of about 120 cm to about 245 cm, wherein the top frame member is joined to the side frame member at an end of the side frame member and each side frame member is joined to the bottom frame member at an opposite end of the side frame member.

A further embodiment of the present invention is where the footer means comprises (i) a first footer and (ii) a second footer, in which the first footer is connected substantially at one end of the frame and the second footer is connected substantially at the opposite end of the frame.

A preferred embodiment of the present invention is the apparatus described above, and which further comprises:

(d) a support rod orientated substantially in the plane substantially perpendicular to the plane of golf teeing areas, with one end of said support rod connected to the top member and the opposite end of said support rod connected to the bottom member and wherein said support rod is orientated along the length of the top member and the bottom member such that the top member remains substantially parallel to the bottom member;

(e) an elongated bag support member with two ends and which is adapted to receive a golf bag, with one end connected to the side frame member at a point approximate to the top frame member and the opposite end connected to the first footer, such that the elongated bag support member is in a position which provides for supporting a golf bag; and (f) a cup holder member which is adapted to receive a cup and which is connected to the frame side member at a point approximate to the top frame member.

A further embodiment of the present invention is the apparatus as described above wherein the unitless ratio of the sum of the length of the first footer (e.g., in cm) plus the length of the second footer (e.g., in cm) over the height of the frame (e.g., in cm) is at least about 1.45, and wherein the unitless ratio of the product of the length of the first footer (e.g., in cm) and the length of the second footer (e.g., in cm) over the area of the interior open space (e g., in $cm^2$) is at least about 0.18.

Additional preferred embodiments of the present invention are where the frame defines a predominately rectangular shaped or oval shaped interior open space. Also, the frame is constructed from metal or plastic tubing, and the barrier is made from sheets of vinyl or any other resiliently strong and flexible material.

DETAILED DESCRIPTION OF THE INVENTION

Figure 1:
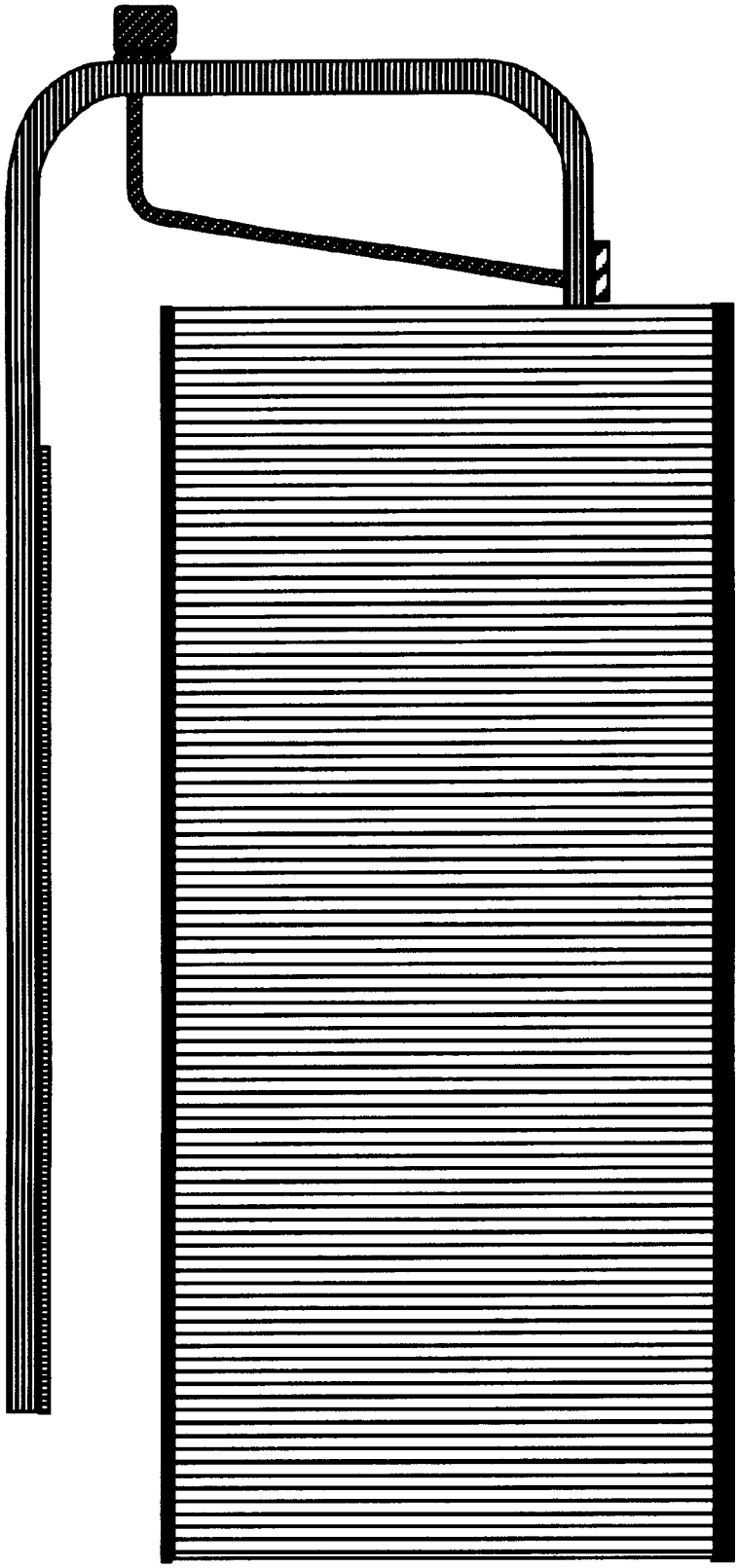
FIG. 1 illustrates the preferred embodiment of the present invention, with the barrier disconnected from the frame and in the foreground.
Figure 2:
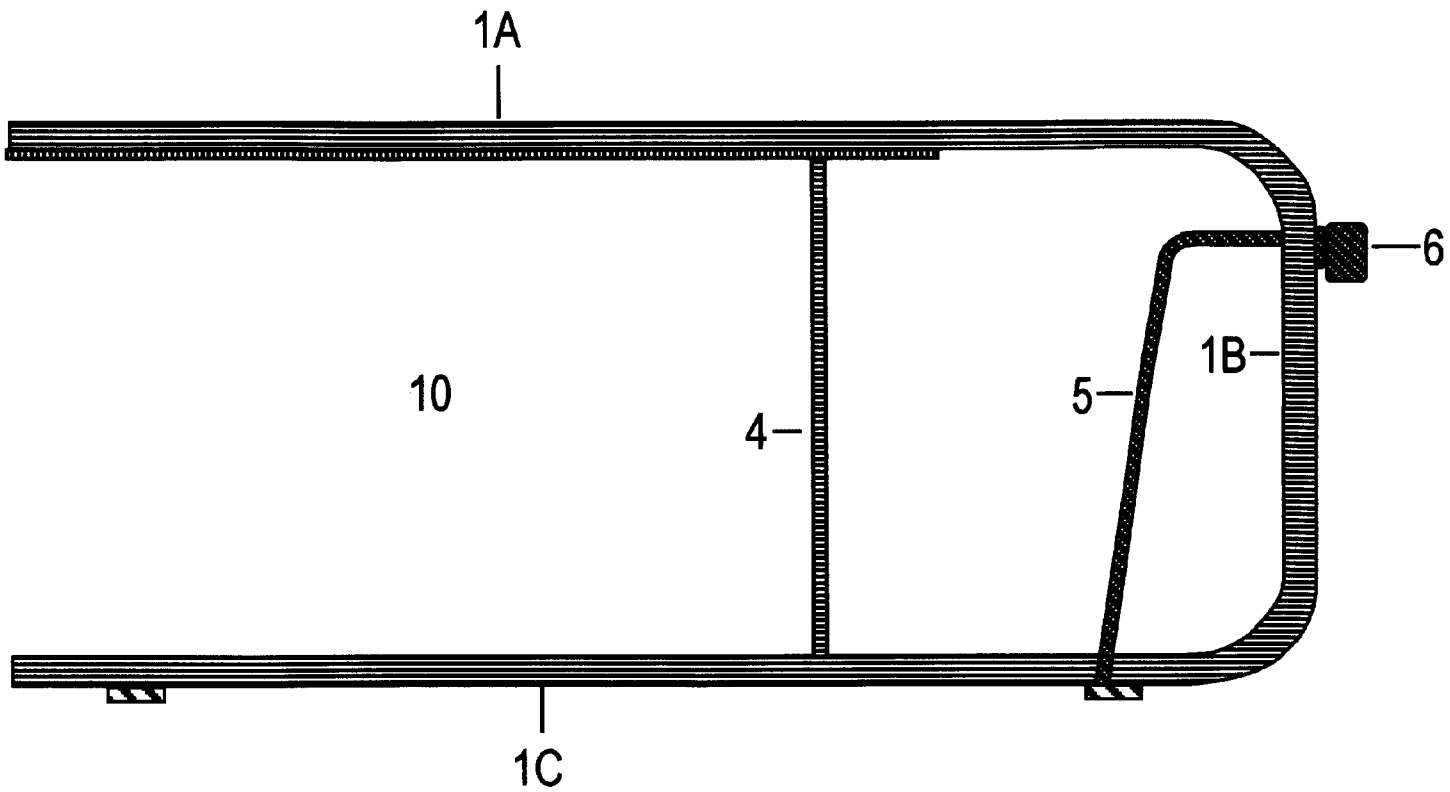
FIG. 2 illustrates the preferred embodiment of the present invention, with the barrier removed, to show the supporting rod and bag stand.
Figure 3:
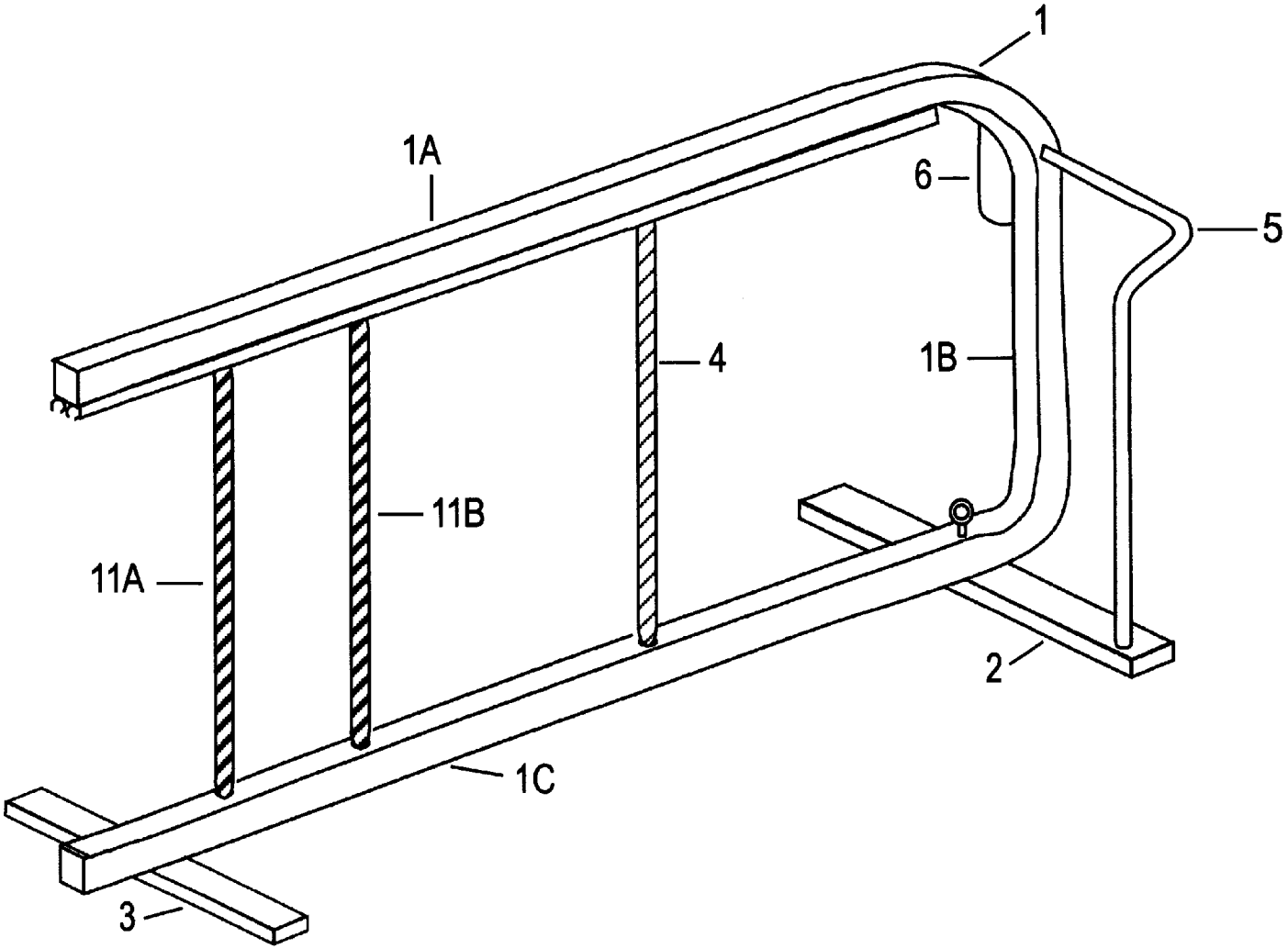
FIG. 3 illustrates an isometric view of the preferred embodiment of the present invention, with the barrier removed, showing the cords and the supporting rod.
Figure 4:
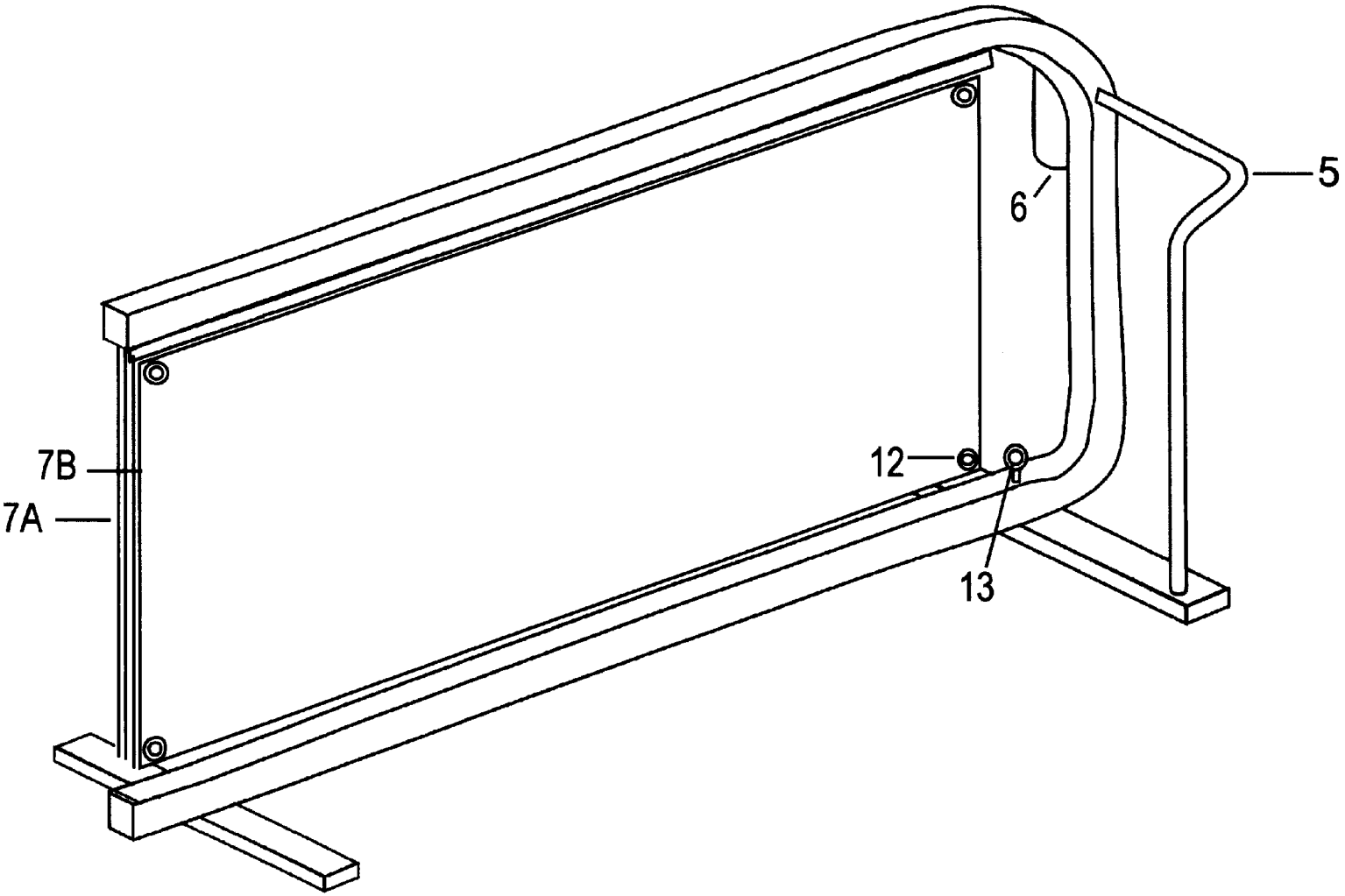
FIG. 4 illustrates an isometric view of the preferred embodiment of the present invention.

The present invention provides a solid barrier to errant golf balls, and includes a system for decelerating the golf ball to minimize or eliminate situations where the ball "ricochets" and strikes practicing golfers. The present invention accomplishes this important function while also providing the practicing golfer additional amenities, and providing the facility operator an additional advertising medium. The present invention also does not need to be affixed to the ground with spikes or fasteners. The footing of the present invention has been developed to provide a secure structure that will withstand wind and errant golf balls while being quickly and easily repositioned as the golf practice range operator desires.

The present invention comprises a frame (1) which is substantially in one dimension and orientated substantially perpendicular to the ground. The frame (1) can be constructed from metal tubing, such as steel, or plastic tubing, such as PVC, of various diameters with the preferred embodiment being 1½ inch diameter steel tubing. When starting with steel tubing, the tubing is bent using apparatus known in the art to create a frame with a substantially U-shape. The frame can also be shaped substantially rectangular or oval.

The frame (1) with a first end and a second end, comprises a top member (1A) and a parallel bottom member (1C). The length of the top and bottom members essentially dictates the overall length of the frame (1). The length of the top member, and therefore, the frame, must be at least about 120 cm. Also, the length must be no more than about 245 cm. The preferred embodiment has a top member length of approximately 198 cm.

The minimum length of the top and bottom members is determined by balancing safety and utility considerations. Testing shows that if the top and bottom members are smaller than 120 cm in length, then the product does not provide the necessary protection for the golfer, because the barrier does not extend far enough away from the hitting area. Inversely, if the top and bottom members are longer than 245 cm, then the product itself creates an obstruction that too often interferes with the natural flight of the ball, and hinders the utility of the practice range facility.

The frame (1) comprises one or two side members (1B). The length of the side member (1B) essentially dictates the height of the frame. The length of the side member (1B), and therefore, the frame (1), must be at least about 60 cm, in order to provide adequate safety from errant golf balls. Also, the length of the side member (1B) must be no more than about 125 cm in order to prevent the frame from toppling over in high winds or when struck by an errant golf ball. The preferred embodiment has a side member length of approximately 79 cm.

A first footer (2) and a second footer (3) are attached to the bottom of the frame to stabilize the frame and maintain the frame substantially perpendicular to the ground. The footers (2) and (3) are shape so as to efficiently provide stability, and results in a configuration in which their length is longer than their width. Footer shapes which achieve this goal include configurations which are substantially rectangular, oval or block "I" shaped. The first footer (2) is positioned substantially near the rear end of the frame (1) and the second footer (3) is positioned substantially near the front end of the frame (1). The footers (2) and (3) can be made of metal, such as steel, or plastic, such as PVC. In the preferred embodiment, the footers are made from ⅜ inch thick steel plate. The metal type footers are welded to a metal frame, or fastened to a plastic frame using standard tie-downs or screws which are common in the art for connecting plastic to metal. Plastic type footers are connected to a plastic frame by tie-downs, screws or adhesives commonly used in the art to connect plastic components.

Tests were conducted on site at a golf practice range facility to determine the effectiveness of the footers. The criteria for proper footer functionality included stability, portability, wind resistance and safety. The portability requirement resulted in the plate design of the footers, as described above and in the drawings. Stability and wind resistance are closely related, with high wind conditions creating peak stability stresses. Based on these parameters, it was found that the first footer (2) must be at least about 25 cm long for every 30 cm of height of the frame (1), and the second footer (3) must be at least about 13 cm long for every 30 cm of height of the frame (1). The lower length for the second footer (3) decreases the risk that an errant golf ball will strike the second footer (3) and deflect the ball in an uncertain, and potentially unsafe, direction. In the preferred embodiment wherein the frame is approximately 79 cm high, the first footer (2) is approximately 76 cm long and 8 cm wide, and the second footer (3) is approximately 38 cm long and 8 cm wide.

The frame (1) defines an interior open space (10). The size of the interior open space (10) is important. The interior open space (10) forms the area that will be substantially occupied by the barrier (7), discussed below. The interior open space (10) must be large enough to ensure that the practicing golfers are protected from errant golf shots, and must be at least about 7,400 $cm^2$. Also, the interior open space (10) must be small enough to inhibit blowing over in windy conditions, and must be less than about 30,000 $cm^2$. In the preferred embodiment, the area of the interior open space is about 15,650 cm. The shape of the interior open space is important to ensure efficient utilization of the present invention, that is, provide maximum interior open space area in those places most likely to receive an errant golf shot, while minimizing the frame perimeter. The interior open space shapes which achieve these objectives are substantially rectangular and oval shaped.

Both the height of the frame (1) and area of the interior open space (10) are inversely proportional to the stability of the frame (1). That is, the higher the frame (1) and the larger the interior open space (10), the more likely it is that the frame (1) will topple over when hit by an errant golf ball or during windy conditions. The increase in frame height and/or interior open space area must be accounted for in the length of the stabilizing footers. It was found that the frame is stable during routine operation and during windy conditions when (a) the unitless ratio of the sum of the length of the footers over the height of the frame is at least 1.45 or (b) the unitless ratio of the product of the length of the two footers over the area of the interior open space is at least 0.18. The ratios are "unitless," because the unit of length or area used, as applicable, are consistent and are, therefore, cancelled out of the ratio equation resulting in a unitless number. The exact unit of length or area used, therefore, is irrelevant so long as it is consistently applied.

In the preferred embodiment a support rod (4) is added near the center of the frame (1) to support the frame in keeping the interior open space shape (e.g., substantially rectangular or oval shaped). The support rod may be constructed from metal tubing or rod (e. g., ½ inch steel rod) or PVC. In the preferred embodiment, with a frame 198 cm long, the support rod (4) is located 76 cm from the frame side member. Additionally, a bag stand (5) is connected to the frame, with one end attached to one side of the first footer (2), and the other end attached to the frame side member (1B). The bag stand (5) can be constructed from metal rod (e.g., ½ inch steel rod) and bent into the desired bag receiving shape, or plastic tubing, such as PVC, and shaped or connected to provided a member adaptable to accept a golf bag. The bag stand (5) of the preferred embodiment also increases stability of the apparatus by supplying rigidity to the frame (1), because one end of the bag stand (5) is connected to the first footer (2), and the other opposite end is connected to the frame (1).

Finally, a cup holder (6) is attached to the frame (1) at approximately the same height as, but opposite to, the bag stand (5). The cup holder (6) may be constructed of a section of piping about 2 cm in diameter and between about 5–10 cm long with a rod connected at the bottom of the open pipe end and orientated substantially along the diameter of the, pipe open end.

The preferred embodiment of the present invention is constructed of metal, and the components assembled by welding. Subsequent to welding, all sharp edges are smoothed by grinding. The entire unit is painted with a primer, and then finished with an industrial grade paint to the desired finish.

Figures 5A, 5B, 5C:
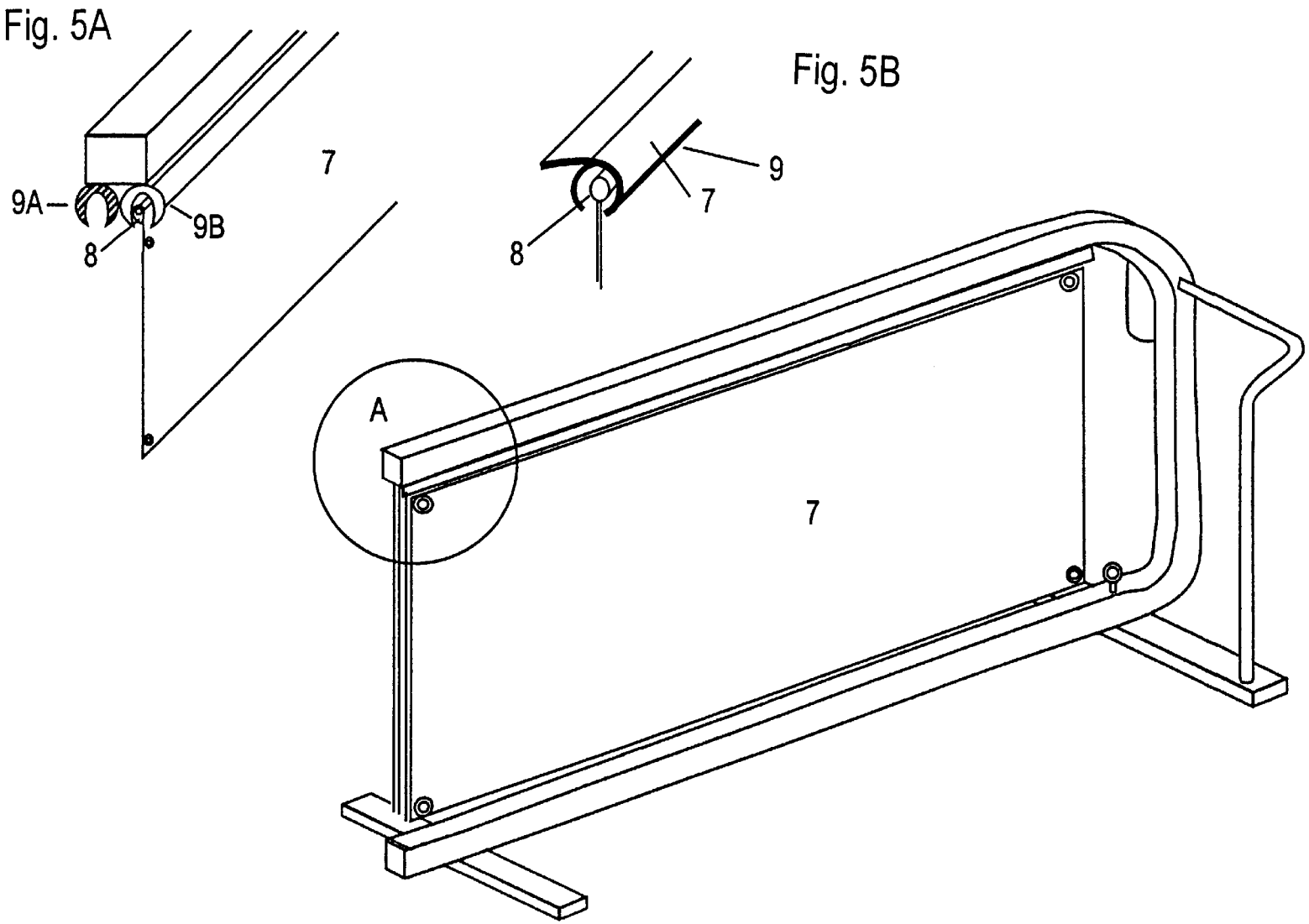
FIG. 5A illustrates an isometric view of the dual tracks into which the barriers are inserted.
FIG. 5B illustrates an isometric view of a track into which the barrier is inserted.
FIG. 5C illustrates an isometric view of the preferred embodiment of the present invention.

Subsequent to grinding and painting, if any, at least one barrier (7) which extends substantially the length of the frame is attached to the top part of the frame (1). The barrier (7) must be constructed of material that is strong enough to prevent an errant golf ball from piercing the barrier, and flexible enough to allow the barrier to retreat in response to the golf ball contact and rapidly reduce the ball velocity, or deflect the ball away from the practicing golfer. The barrier (7) can be constructed of vinyl or any other resiliently strong material. For a vinyl banner, testing has determined that the barrier needs to be a minimum strength of about 15 oz. and a maximum strength of about 18 oz. Any materials lighter than about 15 oz. allows a ball or club to rip through the barrier upon impact. Conversely, materials heavier than about 18 oz. are too stiff, and create a barrier that does not allow the velocity of a ball or club impacting the barrier to be properly absorbed, thereby causing the object to ricochet. The barrier (7) is connected at one end to an insert (8). The insert (8) may be metal or plastic rod. In the preferred embodiment, the barrier (7) is connected to the insert (8) by wrapping the barrier around the insert (8) and fastening with double sided tape. (See FIG. 5). The track (9) is attached to bottom side of the top member (1 A), for example, with 3⁄16 inch aluminum pop rivets, positioned approximately every 5 cm on the center of the top member, and extending the entire length of the barrier (7). One or more tracks (9) (with the number of tracks being equal to the number of barriers employed) may be attached to the top member (1A). In the preferred embodiment, two tracts (9A, 9B) and two barriers (7A, 7B) are employed. The tracks (9A, 9B) may be constructed of metal or plastic, with the preferred embodiment constructed from aluminum. Each track (9) is adapted to receive the insert (8) in an opening on one end and then allow sliding of the insert (8) and, therefore, the barrier (7), into and along the length of the track (9) until the barrier substantially occupies the interior open space (10). The insert (8) and track (9) system allow rapid replacement of barriers when desiring to change advertising or messages on the barrier, or for replacement due to wear. The barrier (7) may be loosely tied at the rear of the frame by threading a line through a hole (12) and eye screw (13) and tying down.

The barrier (7) is not connected to the frame (1) at any point other than through the insert (8) and track (9) combination and the loosely tied line at eye screw (13). This configuration allows the barrier to rapidly decrease the velocity of golf balls which contact the barrier by providing some freedom of movement to the barrier (7) in response to contact by the errant golf ball.

In a preferred embodiment of the invention, two resilient cords (11A, 11E) are attached to the frame (1) at points substantially approximate to each end, and extended from the top to the bottom of the frame (1). In the preferred embodiment, the cords are 3⁄16 inch elastic shock-type cords. The cords (11A, 11B) are attached at the front part of the frame assembly by drilling a 3⁄16" hole in the top and bottom frame members (1A, 1C), threading the cord through the hole and then pulling out the open end of the frame member. The cords (11A, 11B) are knotted after being stretched, and when released, they retract to form a flexible support for the barrier (7). The cords (11A, 11B) assist in inhibiting the movement of the barrier (7) during windy weather conditions, but do not reduce the barrier (7) capacity to stop or deflect errant golf balls.

We claim:

1. A golf practice tee separator apparatus for separating golf teeing areas, comprising:

(a) a substantially rigid frame having two ends, orientated substantially in a plane substantially perpendicular to a plane of golf teeing areas, and defining an interior open space wherein (i) the interior open space is surrounded by rigid frame members on at least three of four sides, comprising (A) a top frame member having an overall length of about 120 cm to about 245 cm, (B) a side frame member substantially perpendicular to said golf teeing areas and having an overall height of about 60 cm to 125 cm, and (C) a bottom frame member oriented substantially in parallel to the top frame member and having a length of about 120 cm to about 245 cm and (ii) the area of the interior open space defined by the rigid frame members is from about 7,400 $cm^2$ to about 30,000 $cm^2$;

(b) a barrier means composed of a thin and flexible sheet-like material that is substantially similar in size and shape to the interior open space, wherein the sheet-like material is fastened to the rigid frame wherein the top frame member is joined to the side frame member at an end of the side frame member and the side frame member is joined to the bottom frame member at an opposite end of the side frame member and the barrier means is connected to the top frame member, and whereby the barrier means functions to absorb the force of moving objects that strike the barrier means and decrease the velocity of such moving objects;

(c) at least one footer means connected to the bottom frame member of the rigid frame and orientated substantially parallel to and adapted to contact the ground and which extends in both directions perpendicular from the plane of the interior open space, whereby the footer maintains orientation of the apparatus frame substantially perpendicular to the golf teeing area despite the forces of wind and being struck by moving objects; and (d) an elongated bag support member having two ends and which is adapted to receive a golf bag, with one end of the elongated bag support member connected to the side frame member at a point approximate to the top frame member and the opposite end of the elongated bag support member is connected to the first footer, such that the elongated bag support is in a position which provides for supporting the golf ball.

2. The apparatus of claim 1 wherein the frame defines a substantially rectangular-shaped interior open space.

3. The apparatus of claim 1 wherein the frame defines a substantially oval-shaped interior open space.

4. The apparatus of claim 1 wherein the frame is composed of metal.

5. The apparatus of claim 1 wherein the barrier is composed of vinyl.

6. The apparatus of claim 1 wherein the barrier is composed of a woven fabric.

7. The apparatus of claim 1 wherein the apparatus further comprises a support rod having two ends and orientated substantially in the plane substantially perpendicular to the plane of golf teeing areas, with one end of said support rod connected to the top frame member and the opposite end of said support rod connected to the bottom frame member and wherein said support rod is orientated along the length of the top frame member and the bottom frame member such that the top member remains substantially parallel to the bottom frame member.

8. The apparatus of claim 1 wherein the apparatus further comprises a cup holder member which is connected to the frame side member at a point approximate to the top frame member and which is adapted to receive a cup.

9. The apparatus of claim 1 wherein the footer means comprises (i) a first footer and (ii) a second footer, and in which the first footer is connected substantially at one end of the bottom frame member and the second footer is connected substantially at an opposite end of the bottom frame member.

10. The apparatus of claim 9 wherein the unitless ratio of the sum of the length of the first footer plus the length of the second footer over the height of the frame is at least 1.45.

11. The apparatus of claim 9 wherein the unitless ratio of the product of the length of the first footer and the length of the second footer over the area of the interior open space is at least 0.18.

12. The apparatus of claim 1 further comprising a second side frame member.

13. A golf practice tee separator apparatus for separating golf teeing areas, comprising:

(a) a substantially rigid frame having two ends, orientated substantially in a plane substantially perpendicular to a plane of golf teeing areas, and defining a substantially rectangular interior open space wherein (i) the interior open space is surrounded by rigid frame members on at least three of four sides; (ii) the interior open space is defined by a top frame member having an overall length of about 120 cm to about 245 cm, a side frame member substantially perpendicular to said golf teeing areas and having an overall height of about 60 cm to 125 cm and a bottom frame member oriented substantially in parallel to the top frame member and having a length of about 120 cm to about 245 cm, (iii) the top frame member is joined to the side frame member at an end of the side frame member and the side frame member is joined to the bottom member at an opposite end of the side frame member and (iv) the area of the interior open space defined by the rigid frame members is from about 7,400 $cm^2$ to about 30,000 $cm^2$;

(b) a barrier means composed of a thin and flexible sheet-like material that is substantially similar in size and shape to the interior open space, wherein the sheet like material is fastened to the top frame member, whereby the barrier means functions to absorb the force of moving objects that strike the barrier means and decrease the velocity of such moving objects;

(c) footer means comprising (i) a first footer and (ii) a second footer, wherein each footer is connected to the bottom frame member and orientated substantially parallel to the ground and wherein each footer extends in both directions perpendicular from the plane of the interior open space and in which the first footer is substantially at one end of the frame and the second footer is substantially at the opposite end of the frame, whereby the footer maintains orientation of the apparatus frame substantially perpendicular to the golf teeing area despite the force of wind and being struck by moving objects;

(d) support rod orientated substantially in the plane substantially perpendicular to the plane of golf teeing areas, with one end of said support rod connected to the top frame member and the opposite end of said support rod connected to the bottom frame member and wherein said support rod is orientated along the length of the frame such that the top frame member remains substantially parallel to the bottom frame member;

(e) an elongated bag support member having two ends and which is adapted to receive a golf bag, with one end of the elongated bag support member connected to the side frame member at a point approximate to the top frame member and the opposite end of the elongated bag support member is connected to the first footer, such that the elongated bag support is in a position which provides for supporting the golf bag; and (f) a cup holder member which is adapted to receive a cup and, which is connected to the frame side member at a point approximate to the top frame member.

14. The apparatus of claim 13 wherein the frame defines an interior open space shape which is substantially oval-shaped.

15. The apparatus of claim 13 wherein the frame is composed of metal.

16. The apparatus of claim 13 wherein the barrier is composed of vinyl.

17. The apparatus of claim 13 wherein the barrier is composed of a woven fabric.

18. The apparatus of claim 13 wherein the unitless ratio of the sum of the length of the first footer plus the length of the second footer over the height of the frame is at least 1.45.

19. The apparatus of claim 13 wherein the unitless ratio of the product of the length of the first footer and the length of the second footer over the area of the interior open space is at least 0.18.

20. The apparatus of claim 13 further comprising a second side frame member.

* * * * *